United States Patent [19]

Lu

[11] 4,434,846

[45] Mar. 6, 1984

[54] PATTERNED HEAT EXCHANGER FIN

[75] Inventor: James W. B. Lu, Greendale, Wis.

[73] Assignee: McQuay Inc., Minneapolis, Minn.

[21] Appl. No.: 251,382

[22] Filed: Apr. 6, 1981

[51] Int. Cl.[3] ..... F28D 7/00; F28F 9/22

[52] U.S. Cl. ..... 165/161; 165/159; 165/182

[58] Field of Search ..... 165/157, 158, 159, 171, 165/181, 152, 109, 182, 183, 184, 161

[56] References Cited

U.S. PATENT DOCUMENTS

| | | | |
|---|---|---|---|
| 1,927,325 | 9/1933 | Ritter | 165/151 |
| 1,940,804 | 12/1933 | Karmazin | 165/151 |
| 1,954,946 | 4/1934 | Opitz | 165/151 |
| 1,971,842 | 8/1934 | Young | 165/151 |
| 2,079,032 | 5/1937 | Opitz | 165/151 |
| 2,252,211 | 8/1941 | Seemiller | 165/152 |
| 2,873,098 | 2/1959 | Morgan | 165/159 |
| 3,032,365 | 4/1962 | Karmazin | 165/151 |
| 3,223,153 | 12/1965 | Simpelaar . | |
| 3,311,163 | 3/1967 | Owen . | |
| 3,360,038 | 12/1967 | Stampes | 165/166 |
| 3,397,741 | 8/1968 | Gunter . | |
| 3,515,207 | 6/1970 | Lu . | |
| 3,780,797 | 12/1973 | Gebelius | 165/55 |
| 4,049,048 | 9/1977 | Leedham | 165/159 |
| 4,245,695 | 1/1981 | Fujikake | 165/133 |
| 4,267,707 | 5/1981 | Hemmerich | 62/514 R |

FOREIGN PATENT DOCUMENTS

| | | | |
|---|---|---|---|
| 32224 | 12/1979 | European Pat. Off. | 165/159 |
| 2809143 | 8/1979 | Fed. Rep. of Germany | 165/151 |
| 436949 | 4/1912 | France | 165/159 |
| 912184 | 8/1946 | France | 165/151 |
| 563191 | 5/1957 | Italy | 165/181 |
| 140253 | 10/1979 | Japan | 165/151 |
| 332455 | 7/1930 | United Kingdom | 165/151 |
| 460063 | 1/1937 | United Kingdom | 165/151 |
| 501673 | 3/1939 | United Kingdom | 165/151 |
| 258323 | 12/1969 | U.S.S.R. | 165/159 |

*Primary Examiner*—William R. Cline
*Assistant Examiner*—John M. Kramer
*Attorney, Agent, or Firm*—Merchant, Gould, Smith, Edell, Welter & Schmidt

[57] ABSTRACT

Embossed patterns on fins for the tubes of a shell and tube type heat exchanger for increased efficiency and heat transfer rate, with minimum additional pressure drop. The fins extend transversely across most of the tubes in the tube bundle and have apertures through which the tubes pass. The embossed patterns, which have a "bow tie" configuration are spaced between adjacent tubes and have a generally convex or concave shape with respect to the planar surface of the fin. Each embossed area has a crest and a pair of opposite sides which slope from the crest down to the planar fin surface, and a pair of opposite arcuately shaped sides which slope from the crest to the planar fin surface, and which have arcs that conform to the arcs of the adjacent tubes. An array of such embossed areas are provided on the fin, and a plurality of fins are placed side by side in the heat exchanger to provide a large surface area for fluid contact.

6 Claims, 8 Drawing Figures

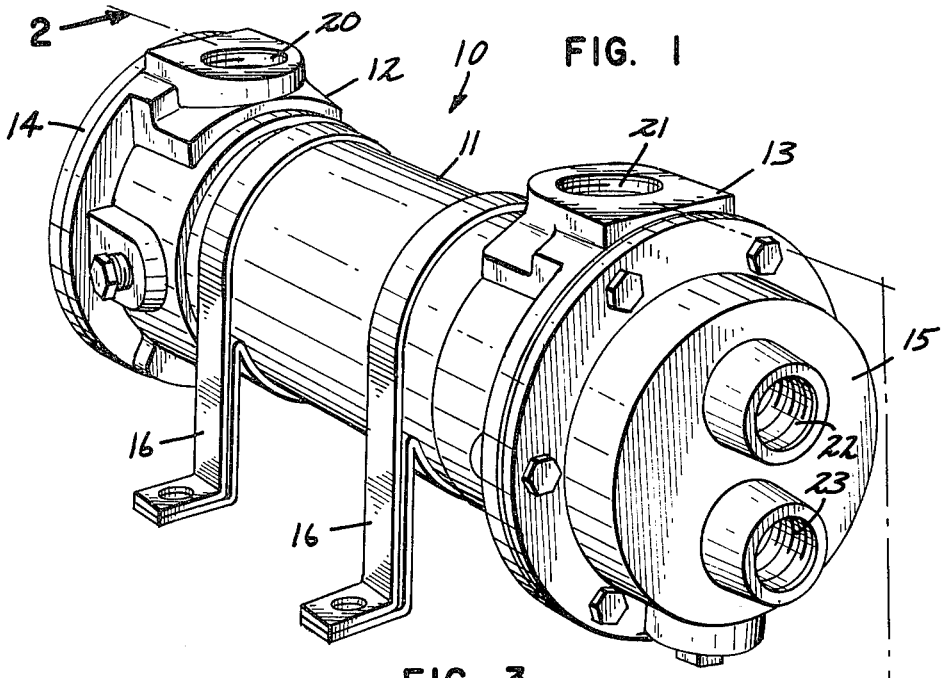
FIG. 1
FIG. 3
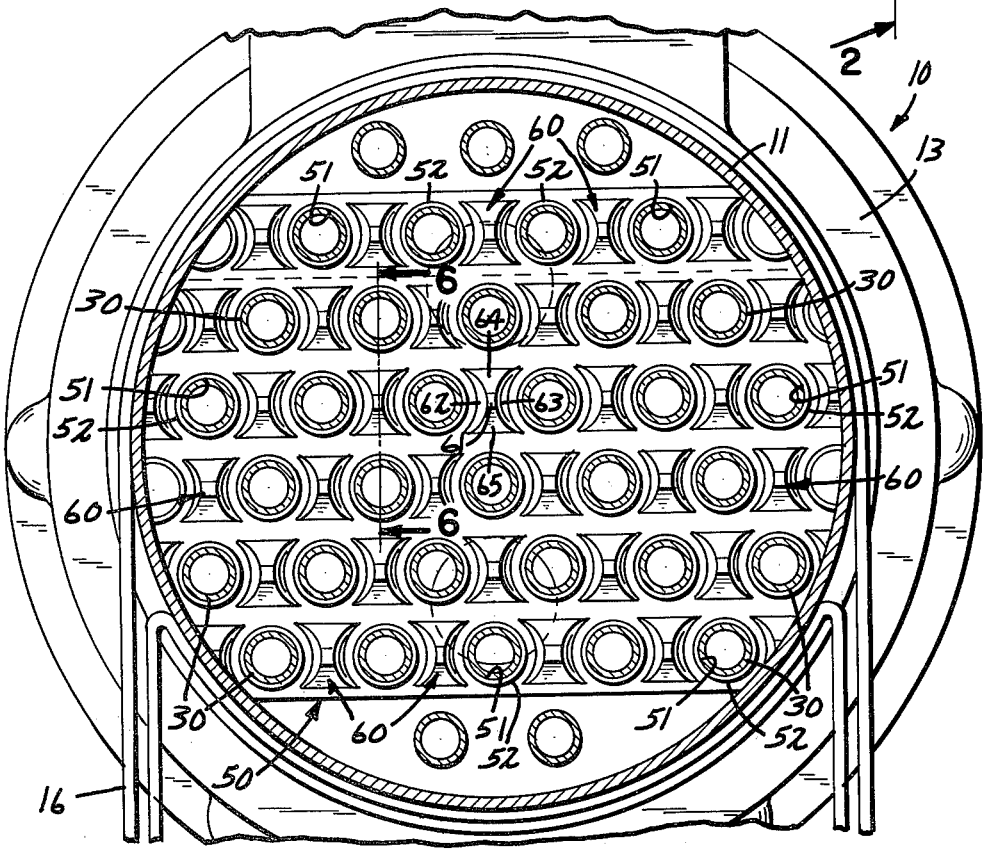

PATTERNED HEAT EXCHANGER FIN

TECHNICAL FIELD

The present invention relates to improvements in shell and tube type heat exchangers, and specifically to an improvement in patterned fins for the tubes in the heat exchanger.

BACKGROUND OF THE INVENTION

Shell and tube type heat exchangers are widely used in a variety of industries in fluid heating or cooling applications. In its most common form, the shell and tube type heat exchanger consists of a plurality of parallel tubes arranged in a bundle, and fitting within a shell. One fluid is circulated through the tubes, while the second fluid circulates within the shell, over and around the tubes to effect thermal transfer between the fluids. Baffles are usually provided to direct the flow within the shell in several passes across the tubes to increase heat transfer, and in some cases fins are provided on the tubes to likewise increase heat transfer. Such fins are secured to the tubes in intimate contact therewith so that the fin essentially increase the surface area of the tube to increase heat transfer.

It is known to provide patterns or discontinuities on the fin surfaces to further improve the heat transfer rate. These patterns or discontinuities may consist of perforations, projections, indentations, and the like on either or both sides of the fin. Fin surface patterns are intended to increase flow turbulence, and as a result, the heat transfer rate.

However, there are certain disadvantages to adding fins and patterns or discontinuities thereon. For one thing, fins generally increase the pressure drop of the fluid flowing across the tubes within the shell, and this requires an increase in the power used to pump or circulate the fluid. Depending upon the application of the heat exchanger, and the heat and flow characteristics of the fluids involved, the increased heat transfer provided by the fins may be more than offset by increased power requirements for circulating the fluid. The same consideration holds for patterns or discontinuities in the fins to create flow turbulence, which will also increase pressure drop and power requirements. In addition, fin surface patterns or discontinuities if improperly designed can aggravate the problem of flow separation which ordinarily occurs on the downstream or back sides of the tubes and which results in a reduction in heat transfer.

Although many fin patterns for use on heat exchanger tubes are known in the prior art, they are still subject to some degree to the problems of excessive pressure drop, flow separations and inadequate heat transfer, depending upon the specific application of the heat exchanger.

The present invention provides an improved heat exchanger fin pattern that provides high efficiency in terms of high heat transfer rate and reasonably low pressure drop. The present invention's unique embossed fin pattern includes contours which guide the fluid flow around the tubes to significantly limit flow separation, and offers advantages over the prior art in that high density fluids requiring a high heat transfer rate can be handled by a heat exchanger using the fins embossed according to the present invention. This allows a heat exchanger to be constructed in a more compact arrangement, resulting in weight, space and costs savings.

SUMMARY OF THE INVENTION

The present invention provides an improved heat exchanger and a patterned fin therefor, for use in a shell and tube type heat exchanger. The fin consists of a generally planar fin member having a spaced array of apertures sized to receive the tubes of the tube bundle in the heat exchanger, with the fin extending generally transverse to the tubes. Preferably a plurality of such fins are provided in spaced parallel relationship to one another. The fins have a plurality of raised patterns which are arrayed across the fin adjacent to and alternating with the tube apertures. Each pattern has a raised central portion, and first and second pairs of surfaces on opposite sides of the raised central portion, which slope downwardly therefrom to join the planar surface.

According to a preferred embodiment, the sloped surfaces of one of the pairs of surfaces are each generally arcuately shaped to conform to the arc shape of adjacent tube apertures. The fin is preferably oriented with respect to fluid flow thereacross so that fluid flowing around tubes generally sweeps along the arcuate sloped surfaces, and flow traveling from the vicinity of one tube to the vicinity of the next tube travels generally up and then down the nonarcuately shaped pair of surfaces of the pattern.

According to another feature of the invention, lips or flanges are provided around the apertures. The fins are preferably stacked or positioned in contact with one another on the tubes, and the flanges contact the adjacent fin. The thickness of the flanges determines the fin spacing or density.

According to a preferred embodiment, the patterns are embossed into the fin member, so as to form a generally concave pattern on one side and a corresponding generally convex pattern on the opposite side.

BRIEF DESCRIPTION OF THE DRAWINGS

In the drawing,

FIG. 1 is a perspective view of a shell and tube type heat exchanger in which the present invention is used;

FIG. 3 is a transverse cross-sectional view of the heat exchanger of FIG. 1, as seen generally along line 3—3 in FIG. 2;

DETAILED DESCRIPTION OF THE PREFERRED EMBODIMENT

Figure 2:
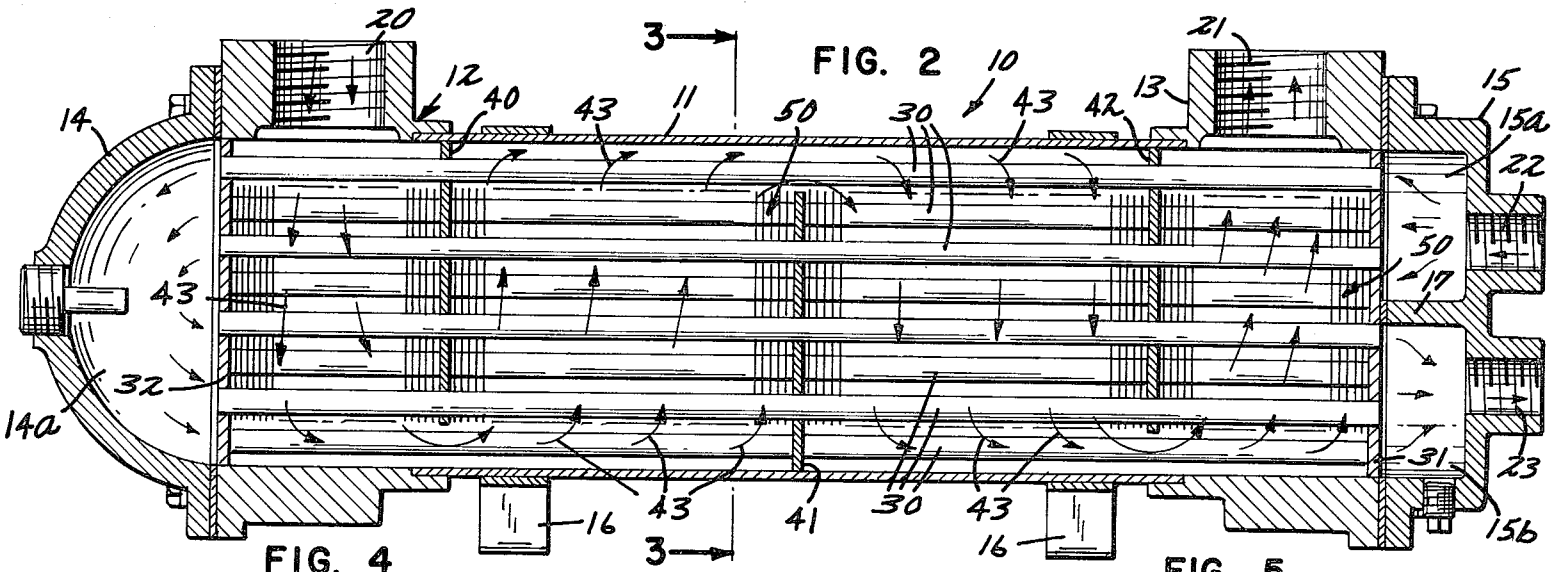
FIG. 2 is a cross-sectional view of the heat exchanger of FIG. 1, as seen along line 2—2 thereof.

Referring now to the drawings, like reference numerals designate identical or corresponding parts throughout the several views.

In FIG. 1, reference number 10 generally designated a shell and tube heat exchanger, typical of the class of heat exchangers in which the present invention finds use. Heat exchanger 10 includes a shell 11, which is preferably of seamless brass tubing. End castings 12 and 13, which may be made of cast iron, are brazed to the ends of shell 11. Cast iron end bonnets 14 and 15 are bolted to flanges in the end castings 12 and 13, respectively, it being understood that suitable gaskets are provided as are known in the art. Mounting brackets 16 are positioned around shell 11 and may be used for mounting the heat exchanger in use.

Not visible in FIG. 1 are the bundle of tubes which extend generally longitudinally within shell 11, plus the baffles, fins and embossed patterns, as described below with reference to other figures. In FIG. 1, fittings or connections 20 and 21 are provided in end castings 12 and 13, respectively, for providing fluid flow through shell 11. Fittings or connections 22 and 23 are provided in end bonnet 15 for providing fluid flow through the tubes. It will be understood that for purposes of example, the heat exchanger shown in FIG. 1 is a two pass heat exchanger so that both the inlet and outlet connections for the tubes are in the same end bonnet; in a single pass heat exchanger one of the fittings or connections 22 or 23 would be in the opposite end bonnet 14.

Referring now to FIG. 2, a plurality of tubes 30, which are preferably made of seamless copper tubing, are held in parallel spaced relationship by tube sheets 31 and 32 to form the tube bundle. The ends of tubes 30 pass through apertures in tube sheets 31 and 32, and the tubes are secured to the tube sheets for example by a silver soldering operation as is generally known. End bonnet 15 has a pair of chambers **15*a* and 15*b* formed therein, separated by a protrusion 17 which is held against the face of tube sheet 31, to define the two passes. For an assumed flow direction as indicated by the flow arrows in FIG. 2, fluid enters fitting 22 and travels through chamber 15*a* to enter one group of tubes. The fluid then flows to the other end of the heat exchanger and into a chamber 14*a* formed within end bonnet 14. The fluid then enters the other group of tubes and travels through them to chamber 15*b*, and then exits fitting 23. For a single pass heat exchanger, projection 17 would not be used, and one of the fittings, for example fitting 23, would be in end bonnet 14. For a four pass construction, additional partitions in end cap 15 and 14** would be used to define four groups of bundles through which the fluid would serially pass, as is generally known in the art.

Baffles 40, 41 and 42 are provided at intervals within the shell. The baffles are circular in section but have short or truncated sides to allow fluid to pass over the baffle. The baffles have openings to allow tubes 30 to pass therethrough. The baffles extend transversely within the shell, but not entirely across the shell so as to leave room for fluid flow around the short or truncated end. Any number of baffles can be used depending upon the application, and they are spaced at intervals and alternated with respect to their short or truncated sides, to form a serpentine flow path for the fluid within the shell, as indicated by the flow arrows 43 in FIG. 2. The baffles effectively seal off fluid flow around the periphery of the baffle and the shell, forcing flow across the tubes and around the short or truncated end of each baffle.

A plurality of fins, indicated by reference number 50, are positioned within the heat exchanger. Each fin consists of a plate having a plurality of apertures to receive each tube. The fins are arranged transversely to the direction of the tubes, in parallel relationship to the baffles and to each other. In use, a great number fins 50 would be employed, for example approximately 15 to 30 fins per inch. The fins would be thus spaced throughout the length of the tubes. However, only a few such fins are shown in FIG. 2 for purposes of clarity. The resulting directed flow of the fluid within shell 10 is between and parallel to the fins, in close thermal contact therewith.

One fin 50 is seen in the cross-sectional view of FIG. 3. The fin extends across most of the width of shell 11 and has in part a circular edge to conform to the shell. The fin is truncated at the top and bottom as seen in the orientation of FIG. 3, corresponding to the orientation of the short or truncated edges of the baffles. This is to provide zones for flow of the fluid essentially parallel to the top and bottom tubes of the bundle before being redirected by the next baffle to flow transverse to the tubes generally parallel to fins 50.

Figure 6:
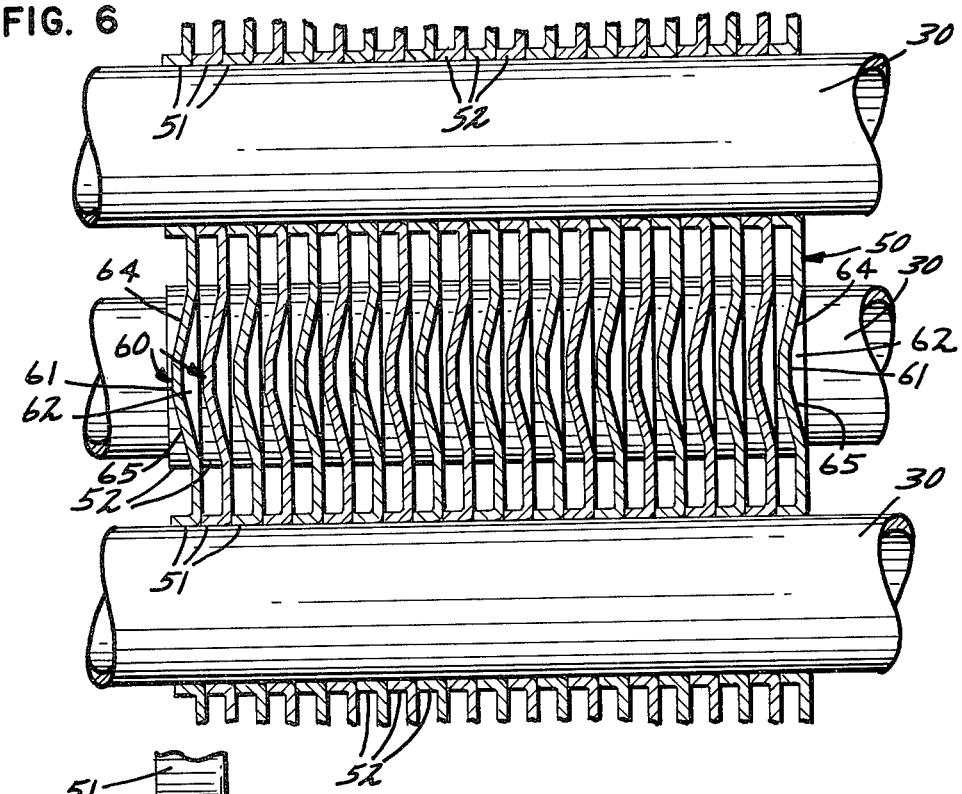
FIG. 6 is a cross-sectional view of the heat exchanger as seen along line 6—6 of FIG. 3.

Each fin 50 has a plurality of apertures 51 which receive the tubes 30. Each aperture 51 has a flange 52, as seen better in FIGS. 6, 7 and 8. The apertures in the fins are sized to initially fit over the tubes, and the tubes are then mechanically expanded by any of various known techniques such as forcing a ball bearing through the tubes or applying hydraulic pressure, to provide a tight and secure fit of the tubes within the apertures in the fins. Flanges 52 provide the dual purpose of increasing the contact area between the fin and the tube, and spacing the individual fins on the tubes in the desired fin density, as seen in FIG. 6.

The embossed patterns 60 are seen in FIG. 3 to be formed between adjacent tube opening, and of course the tubes in adjacent rows are staggered or offset so that embossed patterns lie adjacent to the tubes in all four directions.

Figure 5:
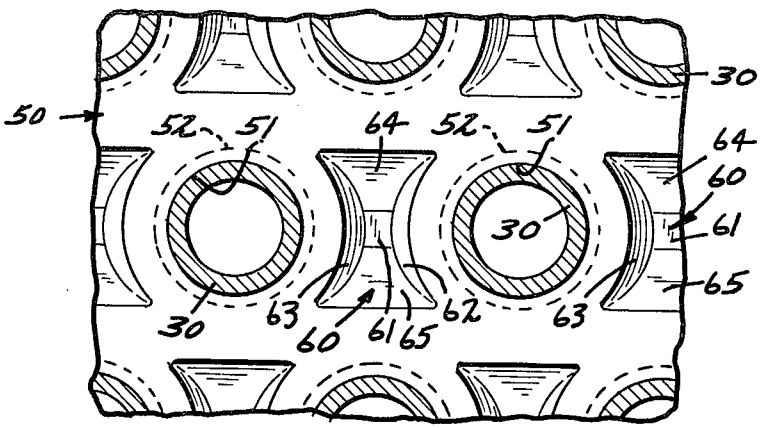
FIG. 5 is a fragmentary rear elevational view of a second side of the fin of FIG. 4, shown in enlarged detail.
Figure 4:
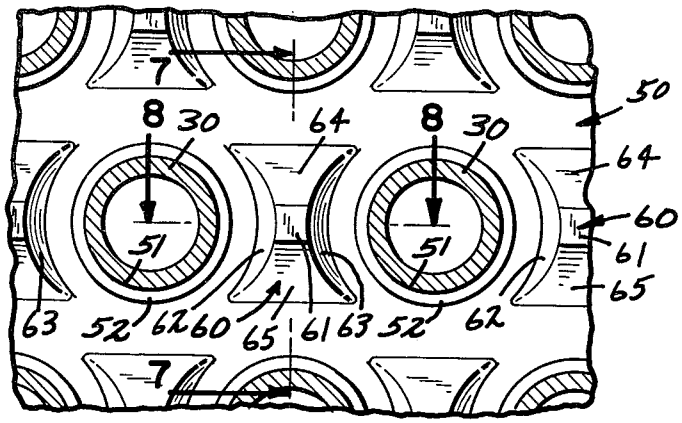
FIG. 4 is a fragmentary front elevational view of a first side of an embossed fin according to the present invention, shown in enlarged detail.
Figure 7:
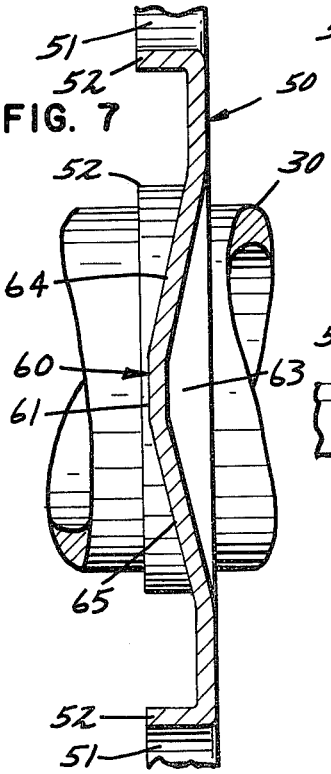
FIG. 7 is a cross-sectional view of a fin as seen along line 7—7 in FIG. 4.
Figure 8:
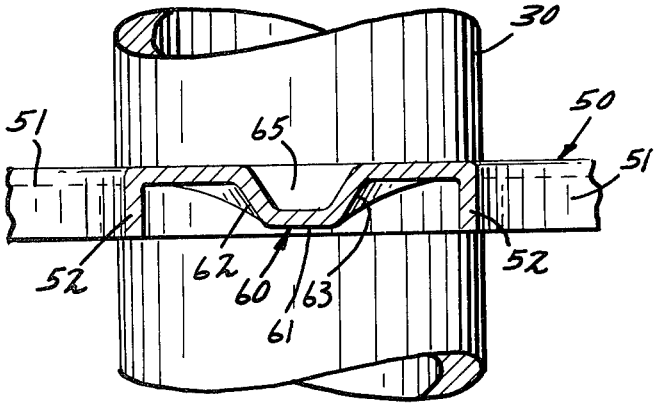
FIG. 8 is a cross-sectional view of a fin as seen along line 8—8 in FIG. 4.

Referring now to FIGS. 4 and 5, the embossed areas 60 are seen in greater detail. The embossed areas have a particular shape, informally referred to as a "bow tie" shape, and they project out of the plane of the fin. When viewed from the side shown in FIG. 4, the embossed patterns 60 are convex and project outwardly from the plane of the figure. When viewed from the other side in FIG. 5, the patterns are concave. The configuration of an individual one of the patterns 60 is seen with reference to FIGS. 4, 7 and 8. The individual embossment has a centrally located crest portion 61, which is displaced from the plane of fin 50, and four sides 62, 63, 64 and 65 which slope downwardly from the crest portion 61 to the flat or planar part of the fin surface. Opposing sides 64 and 65 taper downwardly and outwardly from the crest portion to the planar surface of the fin. Two other opposing sides 62 and 63 are arcuately shaped in an arc generally conforming to the adjacent arcuate edge portion of a tube. Sides 62 and 63 are thus curved in an arc as they extend downwardly from the crest 61 and the edges of sides 64 and 65, to the planar surface of the fin 50. In FIG. 7, the sloping of sides 64 and 65 from crest portion 61 to the planar surface of the fin is more clearly seen. In FIG. 8, the sloping of arcuate sides 62 and 63 from the crest portion to the planar surface of the fin is also seen. In FIG. 5, the embossed pattern 60 has the same "bow tie" appearance as in FIG. 4, but the convex shape as seen in FIG. 4 becomes a concave shape on the reverse surface of the fin as seen in FIG. 5. The crest portion 61 is now in a cavity area as seen from FIG. 5, and the arcuate and tapering sides 62, 63, 64, and 65 extend upwardly from crest 61 to the planar portion of the fin surface.

The embossed pattern 60 is repeated throughout the fin area alternating with the holes for the tubes, and the flanges therearound. Preferably embossed areas 60 and the flanges 52, which both project in the same direction from the fin surface, are made at the same time in a stamping or punching operation.

The pattern of fluid flow around tubes and fins assembled into a tube bundle in a heat exchanger can be visualized with the aid of FIGS. 2, 3 and 6. The orientation of the baffles and fins is such to establish flow of the fluid entering inlet 20 into a number of parallel paths between the adjacent fins. With reference to FIGS. 3 and 6, it can be seen that the flow between two adjacent fins is caused to move around the tubes and over the embossed areas in a number of repeated flow patterns during the course of travel across the fin. For example, in FIG. 3, consider a streamline of flow which encounters a tube, and splits to flow around either side thereof, traveling in the space between the tube and the arcuate sloped sides (62, 63) of the embossed patterns on either side of the tube. The streamlines rejoin on the downstream side of the tube, then travels up slope surface 65 over crest 61 and down sloped surface 64 to encounter the next tube, and repeat the flow pattern. The flow around the tubes and over the embossed areas provide the optimum degree of flow mixing and turbulence for maximum contact between the fluid and the tubes and fins for maximum heat transfer. The relatively smooth transition over and around the embossed areas results in a minimum of additional pressure drop, and the arcuately sloped areas help direct flow around the tubes to minimize flow separation.

Thus, the patterned fins according to the present invention provide a shell and tube type heat exchanger having greater thermal efficiency in terms of heat transfer, while minimizing any additional pressure drop. These advantages in turn permit a more compact and effective heat exchanger structure.

What is claimed is:

1. A heat exchanger, comprising:

a plurality of heat exchange tubes having a generally circular cross-section;

a shell;

means supporting the tubes in generally parallel relationship to one another within the shell to form a heat exchanger with a flow path for a first fluid within the tubes and a flow path for a second fluid within the shell around the tubes;

a plurality of fins positioned on the tubes to define flow paths therebetween for the second fluid, each fin comprising a member having a generally planar surface, the member extending transversely of a plurality of tubes and having apertures through which the tubes pass, and having a plurality of patterns between adjacent tube apertures; and said patterns each having a crest portion raised from the planar surface, a first pair of surfaces that slope from the crest portion, on opposite sides thereof, to the planar surface, said first pair of surfaces having arcuately shaped edges with an arc conforming to the arc of adjacent tube apertures, and a second pair of surfaces arcuately sloping downward from the crest portion and the edges of the first pair of surfaces to the planar surface adjacent tube apertures on either side of the pattern.

2. A heat exchanger according to claim 1 wherein said fins and tubes are oriented in the heat exchanger so that said first pairs of sloped surfaces of said patterns are aligned generally with the flow of fluid across the fins from one tube to another.

3. A heat exchanger according to claim 1 wherein said patterns are embossed in said fin member so that said patterns are generally convex on one side of the fin member and generally concave on the other.

4. A patterned fin for the tubes in a tube bundle of a shell and tube type heat exchanger, comprising a fin member having a generally planar surface, having a spaced array of generally circular apertures to receive the tubes of the bundle, and having a spaced array of raised patterns adjacent to and alternating with the tube apertures, said apertures and patterns arrayed in columns and rows offset from one another so that except at edges of the fin each aperture is adjacent four patterns, the patterns each having a raised central portion, a first pair of surfaces on opposite sides of the central portions and sloping downwardly therefrom to the planar surface, and having a second pair of surfaces on opposite sides of the central portion and sloping downwardly therefrom to the planar surface adjacent a pair of tube apertures, said second pair of surfaces having a generally arcuate shape conforming to the curvature of the adjacent tube apertures.

5. A patterned fin according to claim 4 wherein said patterns are embossed in the fin member to form a generally concave configuration on one side and a corresponding convex configuration on the opposite side thereof.

6. A patterned fin for the tubes in a tube bundle of a shell and tube type heat exchanger, comprising a fin member having a generally planar surface, having a spaced array of generally circular apertures to receive the tubes of the bundle, and having a spaced array of raised patterns adjacent to and alternating with the tube apertures, said apertures and patterns arrayed in columns and rows offset from one another so that pairs of apertures adjacent each other in said rows and columns are separated by said patterns, the patterns each having a raised central portion, a first pair of surfaces on opposite sides of the central portion and sloping downwardly therefrom to the planar surface, and having a second pair of surfaces on opposite sides of the central portion and sloping downwardly therefrom to the planar surface adjacent a pair of tube apertures, said second pair of surfaces having a generally arcuate shape conforming to the curvature of the adjacent tube apertures.

* * * * *